United States Patent [19]

Tsusaka et al.

[11] Patent Number: 4,920,927

[45] Date of Patent: May 1, 1990

[54] COOLING STRUCTURE FOR LIQUID-COOLED ENGINE

[75] Inventors: Haruo Tsusaka, Tokyo; Hirohisa Ishikawa, Saitama; Akihisa Shinoda, Saitama; Motohiro Fujita, Saitama, all of Japan

[73] Assignee: Honda Giken Kogyo Kabushiki Kaisha, Tokyo, Japan

[21] Appl. No.: 280,474

[22] Filed: Dec. 6, 1988

[30] Foreign Application Priority Data

Dec. 7, 1987 [JP] Japan ..... 62-308974
Dec. 7, 1987 [JP] Japan ..... 62-308975

[51] Int. Cl.[5] ..... F01P 3/00

[52] U.S. Cl. ..... 123/41.43; 123/41.42; 165/86

[58] Field of Search ..... 123/41.43, 41.48, 41.34, 123/41.42, 41.47; 165/86; 244/57

[56] References Cited

U.S. PATENT DOCUMENTS

| | | | |
|---|---|---|---|
| 584,920 | 6/1897 | Capitaine | 123/41.43 |
| 942,493 | 12/1909 | Fesler | 123/41.43 |
| 2,746,434 | 5/1956 | Swenson | 123/41.43 |
| 4,053,013 | 10/1977 | Guba | 165/86 |
| 4,643,135 | 2/1987 | Wiische | 123/41.47 |

FOREIGN PATENT DOCUMENTS

| | | | |
|---|---|---|---|
| 480786 | 8/1929 | Fed. Rep. of Germany | 123/41.42 |
| 501995 | 7/1930 | Fed. Rep. of Germany . | |
| 594875 | 3/1934 | Fed. Rep. of Germany . | |
| 762513 | 11/1960 | Fed. Rep. of Germany . | |
| 900898 | 7/1945 | France . | |
| 2501933 | 9/1982 | France . | |
| 1048818 | 12/1980 | Italy . | |
| 188835 | 10/1982 | Italy . | |
| 1115349 | 2/1986 | Italy . | |
| 5837920 | 9/1956 | Japan . | |
| 54-16040 | 2/1979 | Japan . | |
| 62-92713 | 6/1986 | Japan . | |
| 63-170519 | 7/1988 | Japan . | |
| 35421 | 1/1906 | Switzerland | 123/41.43 |
| 171746 | 11/1921 | United Kingdom . | |
| 706764 | 4/1954 | United Kingdom . | |
| 782009 | 8/1957 | United Kingdom . | |
| 999667 | 7/1965 | United Kingdom . | |

*Primary Examiner*—Noah P. Kamen
*Attorney, Agent, or Firm*—Armstrong, Nikaido, Marmelstein, Kubovcik & Murray

[57] ABSTRACT

A cooling structure for cooling a liquid-cooled engine has engine cooling passages defined in portions of the engine for circulating a cooling medium therethrough. The cooling structure further includes a rotatable assembly having a rotatable element located outside of the engine, and a radiation passage system of a prescribed length disposed in the rotatable element for rotation therewith and connected to the engine cooling passages.

16 Claims, 3 Drawing Sheets

COOLING STRUCTURE FOR LIQUID-COOLED ENGINE

BACKGROUND OF THE INVENTION

1. Field of the Invention:

The present invention relates to a cooling structure for cooling an engine with a cooling medium or coolant such as water, a lubricant, or the like.

2. Description of the Relevant Art:

Japanese Laid-Open Utility Model Publication No. 58-37920 discloses an engine cooling structure for cooling an engine by supplying a liquid coolant such as water, an engine lubricant, or the like to suitable locations in the engine with a pump. The disclosed engine cooling structure has a coolant passage defined in a water jacket around a cylinder for the cooling liquid to flow therethrough to cool the cylinder, the cooling liquid also serving as a sound insulation.

The disclosed engine cooling structure is advantageous over a cooling structure for cooling an engine with air in that it can cool the engine and reduce the noise of the engine more effectively than the air-cooled engine system.

Cooling structures for cooling engines with water are associated with radiators. As disclosed in Japanese Laid-Open Utility Model Publication No. 61-92713, a cooling structure for cooling an engine with a lubricant is combined with an oil cooler for cooling the lubricant. In either case, a radiator of some kind for lowering the temperature of the cooling medium is required in addition to the engine itself. Therefore, while the conventional liquid-based engine cooling structure can attenuate the engine noise, it is necessary to provide a space for installing the radiator in addition to the engine itself. As a result, the overall engine system is large in size. This problem has proven particularly undesirable with respect to general-purpose engines for use on various working machines since such engines are required to be compact.

In view of the aforesaid drawback of the conventional cooling structures for cooling engines with cooling liquids, the present invention has been made in an effort to effectively eliminate the problem.

SUMMARY OF THE INVENTION

It is an object of the present invention to provide a cooling structure for cooling an engine with a cooling liquid, the cooling structure making an overall engine system small in size, being made up of a reduced number of parts, and having an increased ability to radiate the heat emitted by the engine.

To achieve the above object, there is provided in accordance with the present invention a cooling structure for cooling a liquid-cooled engine having engine cooling passages defined in portions of the engine for circulating a cooling medium therethrough, the cooling structure comprising a rotatable assembly having a rotatable element located outside of the engine, and a radiation passage system of a prescribed length disposed in the rotatable element for rotation therewith and including a portion and another portion which are connected to the engine cooling passages.

The above and further objects, details and advantages of the present invention will become apparent from the following detailed description of a preferred embodiment thereof, when read in conjunction with the accompanying drawings.

DESCRIPTION OF THE PREFERRED EMBODIMENTS

Figure 1:
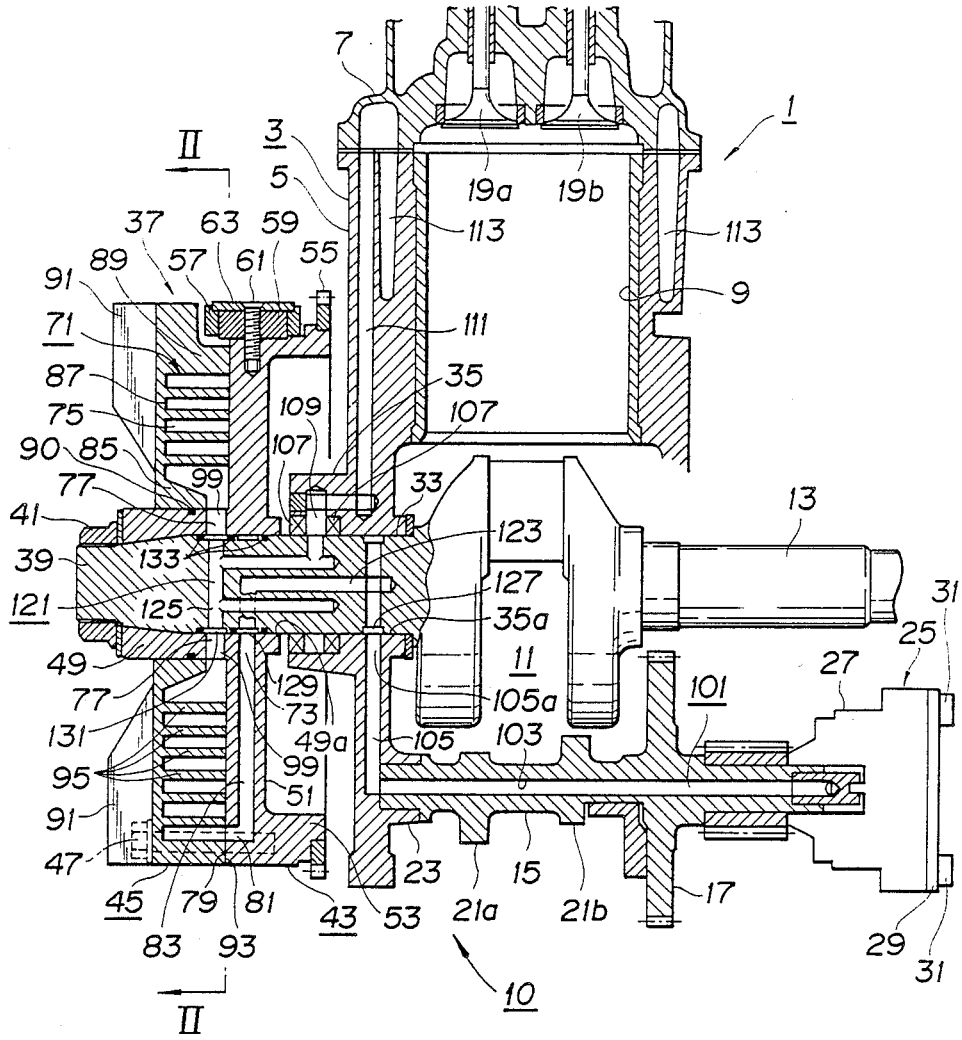
FIG. 1 is a vertical cross-sectional view of a cooling structure for cooling an engine with a cooling liquid according to a first embodiment of the present invention.

FIG. 1 shows a cooling structure, generally designated by the reference numeral 10, for cooling an engine with a cooling liquid according to a first embodiment of the present invention. The cooling structure 10 is combined with a general-purpose liquid-cooled engine 1 having an engine case 3 and various parts thereof lubricated and cooled by a lubricant such as lubricating oil.

The engine case 3 basically comprises a cylinder block 5 and a cylinder head 7. The cylinder block 5 has a cylinder 9 and a crank chamber 11 in which a crankshaft 13 is rotatably inserted. In the cylinder block 5, there is also rotatably supported a camshaft 15 including an integral gear 17 meshing with a gear (not shown) on the crankshaft 13. Therefore, the camshaft 15 is rotatable about its own axis by the crankshaft 13 through the gear 17 and the gear (not shown) on the crankshaft 13.

The camshaft 15 has axially spaced cams 21*a*, 21*b* for opening and closing an intake valve 19*a* and an exhaust valve 19*b*, respectively. The camshaft 15 has one end rotatably supported in a bearing 23 of the cylinder block 5 and the other end coupled to an oil pump 25. The oil pump 25 has a pump case 27 fastened by bolts 31 to a plate 29 attached to the engine case 3. Thus, the camshaft 15 serves as a drive shaft for the oil pump 25.

The crankshaft 13 has a journal 33 rotatably supported in another bearing 35 of the cylinder block 5, and has one end projecting from the bearing 35 out of the cylinder block 5. The projecting outer end of the crankshaft 13 has a tip end 39 on which a flywheel 37 is concentrically mounted by a nut 41. The flywheel 37 comprises two members 43, 45 which can axially be divided in the axial direction of the crankshaft 13.

The inner member 43 of the flywheel 37 which is positioned closer to the cylinder block 43 is made of a magnetic material such as cast iron or the like. The outer member 45 which is positioned closer to the tip end 39 of the crankshaft 13 is made of a material having a high thermal conductivity such as an aluminum alloy or the like. The flywheel members 43, 45 are fastened to each other at their outer circumferential edge portions by means of bolts 47.

The inner member 43 comprises a disc 51, a boss 49 projecting from the center of the disc 51 transversely thereto, and a cylindrical flange 53 extending from the outer circumference of the disc 51 toward the cylinder block 5. The boss 49 of the inner member 43 is fitted over the outer end of the crankshaft 13.

A starter gear 55 is fitted over the cylindrical flange 53. A plurality of magnets 59 accommodated in respective holders 57 are attached at circumferentially spaced locations to the outer circumference of the flange 53 by means of screws 61 and holder plates 63. The stator coil of a generator (not shown) is disposed radially outwardly of the inner member 43, which serves as the rotor of the generator.

The flywheel 37 has a radiation passage system 71 for lowering the temperature of the lubricant. The radiation passage system 71 comprises lubricant inlets 73, a labyrinth passage 75, and two lubricant outlets 77. The labyrinth passage 75, which is a major passage of the radiation passage system 71, is jointly defined by confronting surfaces of the flywheel members 45, 43.

There are two lubricant inlets 73 defined in the inner peripheral surface 49*a* of the disc 51 of the inner member 43 and circumferentially spaced from each other. From the respective lubricant inlets 73, there extend passages 83 radially outwardly, the passages 83 being defined in the disc 51. The passages 83 communicate with openings 81 which open at a mating surface 79 of the member 43 which faces the member 45.

The outer member 45 comprises a disc 87 having a central boss 85, and a cylindrical flange 89 extending from the outer circumference of the disc 87 toward the inner member 43. The boss 85 is fitted over the boss 49 of the inner member 43 with an O-ring 90 interposed therebetween such that the disc 87 is positioned closer to the tip end of the crankshaft 13.

The disc 87 has a plurality of cooling fins 91 on its outer surface which extend radially and are circumferentially spaced.

Figure 2:
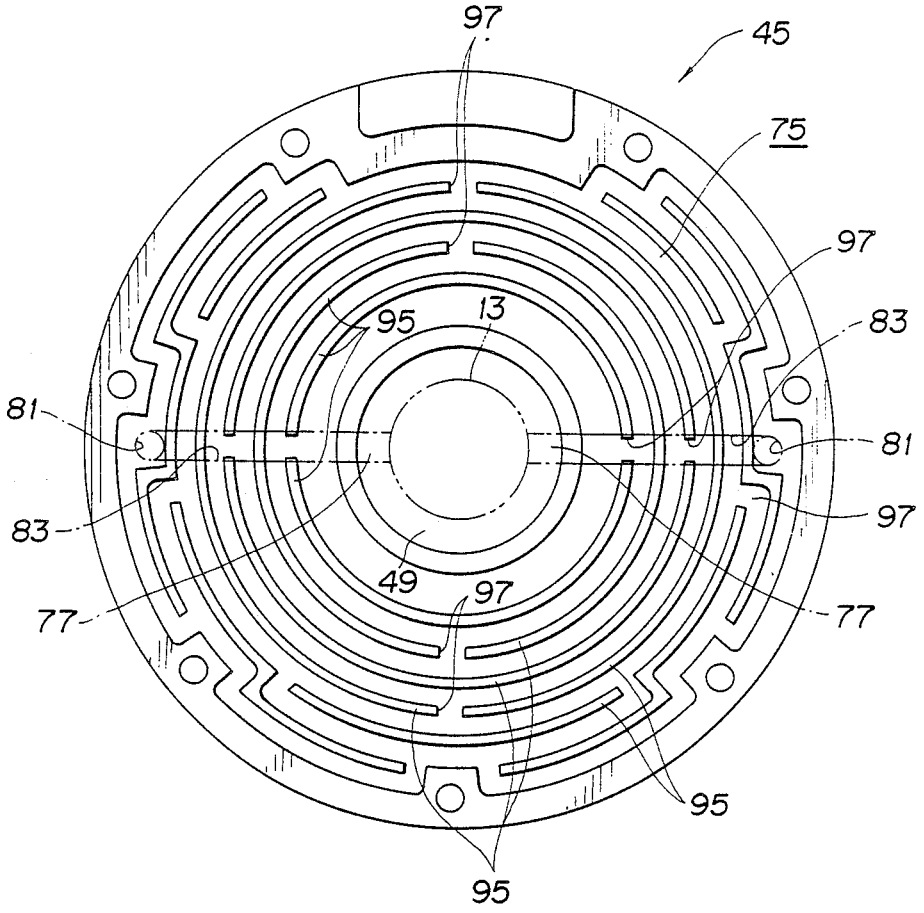
FIG. 2 is a view taken along line II—II of FIG. 1.

As shown in FIG. 2, the inner surface of the disc 87 has a plurality of concentric arcuate walls 95 projecting against the mating surface 79 of the inner member 43, the arcuate walls 95 having angularly displaced recesses 97. The walls 95 have end surfaces which jointly provide a mating surface 93 of the outer member 45 which confronts the mating surface 79 of the inner member 43.

The labyrinth passage 75 is defined jointly by the mating surface 79 of the inner member 43, the inner surface of the disc 87 of the outer member 45, the projecting walls 95, the boss 49, and the boss 85, the labyrinth passage 75 extending radially from the inner circumferential portion to outer circumferential portion of the flywheel 37. The openings 81 are defined in the outer circumferential portion of the labyrinth passage 75. The boss 49 have two passages 99 defined therein an extending radially inwardly from the inner circumferential portion of the labyrinth passage 75. The passages 99 open at the inner peripheral surface 49*a* of the boss 49, defining the lubricant outlets 77.

A cooling passage system 101 for supplying the lubricant to lubricate and cool the engine 1 will be described below.

The cooling passage system 101 comprises a passage 103 defined axially in the camshaft 15 connected to the oil pump 25, a passage 105 defined in a side wall of the cylinder block 5 in communication with the passage 103 and has an opening 105*a* which opens at the inner peripheral surface 35*a* of the bearing 35, an annular groove 109 defined in the inner peripheral surface 35*a* and sandwiched axially between oil seals 107, a passage 111 defined in the side wall of the cylinder block 5 and extending from the annular groove 109 toward the cylinder block 7, and a passage 113 defined in the cylinder block 5 around the cylinder 9. The noise produced by the engine is attenuated by lubricating oil which flows through the cooling passage system 101, particularly the passage 113 defined around the cylinder 9.

The radiation passage system 71 and the cooling passage system 101 is connected to each other by a joint passage 121 defined in the crankshaft 13.

The joint passage 121 comprises a first passageway 123 via which the opening 105*a* and the lubricant inlets 73 communicate with each other, and a second passageway 125 via which the lubricant outlets 77 and the annular groove 109 communicate with each other.

The crankshaft 13 has annular grooves 127, 129, 131 defined in the outer peripheral surface thereof respectively at areas facing the opening 105*a*, the lubricant inlets 73, and the lubricant outlets 77. O-rings 133 are fitted over the crankshaft 13 on opposite sides of the annular grooves 129, 131 which open into the lubricant inlets 73 and the lubricant outlets 77, respectively.

The flow of the lubricating oil which serves as the cooling medium in the cooling structure will be described below.

The crankshaft 13 and the flywheel 37 are rotated together by the power from the engine 1, and the camshaft 15 is also rotated to actuate the oil pump 25.

The lubricating oil flows from the oil pump 25 through the passages 103, 105, the first passageway 123, and the passages 83 into the radiation passage system 71.

Since the radiation passage system 71 is rotated about the axis of the crankshaft 13, the lubricating oil therein is cooled at a rate substantially proportional to the rotational speed of the radiation passage system 71, so that the temperature of the lubricating oil is lowered.

After the heat of the lubricating oil has been radiated in the radiation passage system 71, the lubricating oil is supplied via the second passageway 125 into the passages 111, 113 in the cylinder block 5. The lubricating oil is repeatedly circulated through the cooling passage system 101 and the radiation passage system 71 by the oil pump 25.

The journal 33 of the crankshaft 13 is simultaneously lubricated since the lubricating oil is transferred between the passage 105 and the first passageway 123 and also between the second passageway 125 and the annular groove 109.

In the cooling structure 10 of the above construction, the flywheel or rotatable element 37 of a prescribed diameter which is rotatable with the rotatable shaft or crankshaft 13 rotatable by the power of the engine 1 is disposed on the portion of the shaft 13 which projects from the engine case 3, and the radiation passage system 71 of a prescribed length for radiating the heat from the engine cooling medium or liquid is defined in the rotatable element 37. The cooling passage system 101 is connected at its intermediate portion to the radiation passage system 71. The rotatable shaft 13 has the joint passage 121 defined therein for returning the engine cooling medium fed from the pump 25 via the radiation passage system 71 to the cooling passage system 101 (111, 113). The radiation passage system 71 is rotated at a relatively high speed. Thus, the overall engine system is reduced in dimensions, and the cooling structure 10 is made up of a reduced number of parts while achieving an increased heat radiation capability.

More specifically, the radiation passage system 71 is rotated when the crankshaft 13 of the engine 1 is rotated. Therefore, the radiation passage system 71 has a high heat radiation efficiency and a sufficient heat radiation capability even if it is small in size. As a result, no special space necessary for installing the radiation passage system 71 is required, making the overall engine system small in size. Where the engine 1 is installed on a working machine such as an engine-operated lawn mower, grass clippings which may fall on the passage system 71 can be scattered away from the passage system 71 when it is rotated.

The engine cooling structure 10 is constructed from the camshaft, the crankshaft, and the flywheel which are normally associated with the engine 1. The radiator, cooling fin, oil cooler, and other components which are found on conventional engine cooling structures can thus be dispensed with. Consequently, the overall size of the engine 1 is reduced in size, and the number of parts of the engine system is reduced. The number of parts of the engine cooling structure is small since the radiation passage system 71 can simply be constructed.

The cooling passage system 101 is connected to the radiation passage system 71 through the crankshaft 13. Therefore, the cooling medium can be transferred between the cooling passage system 101 and the radiation passage system 71 without increasing the number of components used.

The engine cooling structure 10 employs the engine cooling oil as the medium for cooling the engine 1. Therefore, the various portions of the engine 1 are lubricated and cooled at the same time, and the engine lubricating oil is effectively utilized.

The flywheel 37 is made up of the two members 43, 45 which can be divided in the axial direction of the crankshaft 13. The radiation passage system 71 is defined jointly by the confronting surfaces of the flywheel members 43, 45. Therefore, the passage system 71 is constructed with ease. The flywheel member 45 is made of a material having a high thermal conductivity, whereas the other flywheel member 43 is made of a magnetic material. Consequently, the heat radiation efficiency of the radiation passage system 71 is increased, and the flywheel 37 itself doubles as the rotor of the generator. The number of parts of the engine 1 is thus further reduced.

Figure 3:
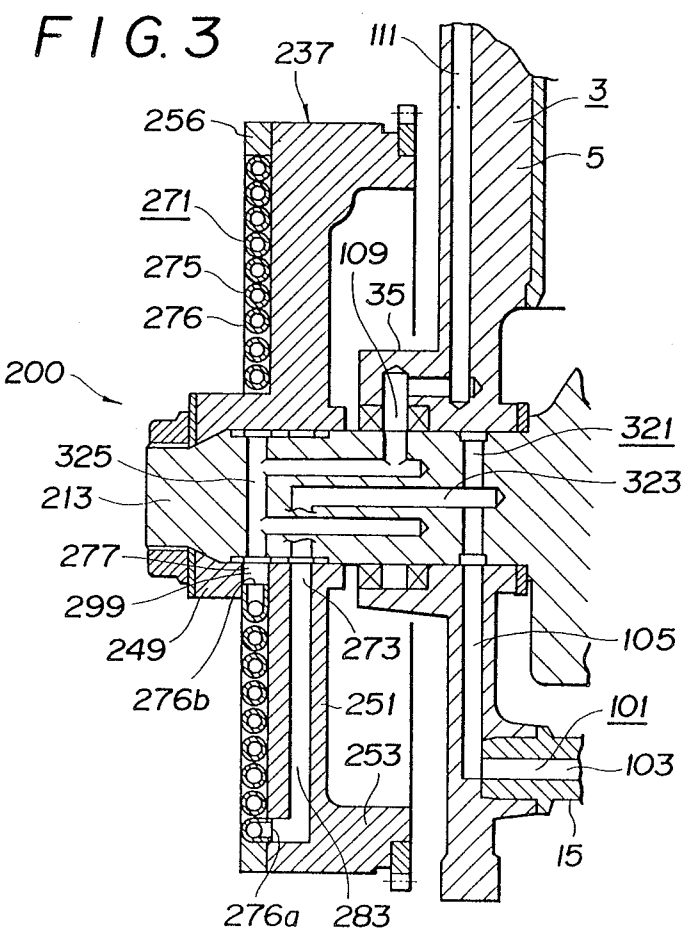
FIG. 3 is a vertical cross-sectional view of a cooling structure for cooling an engine with a cooling liquid according to a second embodiment of the present invention.

FIG. 3 shows a cooling structure 200 for cooling an engine with a cooling liquid according to a second embodiment of the present invention. Those parts shown in FIG. 3 which are identical to those of the cooling structure 10 of the first embodiment are denoted by identical reference numerals, and will not be described in detail.

The engine cooling structure 200 differs from the engine cooling structure 10 in that a radiation passage system 271 defined in a flywheel 237 mounted on an end of a crankshaft 213 is made up of a tube 276.

The flywheel 237 comprises a disc 251, a boss 249 fitted over the crankshaft 213 and projecting from a central portion of the disc 251 transversely thereto, and a cylindrical flange 253 extending from the outer circumferential portion of the disc 251 toward the cylinder block 5. An annular holder 256 is attached to the outer circumferential edge of the outer surface of the disc 251.

The radiation passage system 271 comprises a lubricant inlet 273, a spiral passage 275, and a lubricant outlet 277. The spiral passage 275 is defined in the single tube 276 which is spirally coiled in a vertical plane and joined to the outer surface of the disc 251 radially between the outer circumferential surface of the boss 249 and the inner circumferential surface of the annular holder 256.

The radiation passage system 271 is held in communication with the cooling passage system 101 through a joint passage 321 defined in the crankshaft 213. More specifically, the lubricant inlet 273 is defined in the flywheel 237 in communication with a first passageway 323 defined in the crankshaft 213. A passage 283 is defined in the disc 251 of the flywheel 237 and interconnects the lubricant inlet 273 and a radially outer end **276*a* of the tube 276**.

The lubricant outlet 277 of the radiation passage system 271 is defined in the flywheel 237 in communication with a second passageway 325 defined in the crankshaft 213. The flywheel 237 also has a passage 299 interconnecting the lubricant outlet 277 and a radially inner end **276*b* of the tube 276**.

With the engine cooling structure 200, the heat of lubricating oil is radiated from the radiation passage system 271. The engine cooling structure 200 is of basically the same construction as that of the engine cooling structure 10. Therefore, the engine cooling structure 200 is also effective in making the engine system compact. The radiation passage system 271 can be provided simply by attaching the tube 276 as spirally coiled to the outer surface of the flywheel 237.

In the engine cooling structures 10, 200, the crankshaft 13, 213 is employed as the shaft member which is rotatable by the power of the engine 1, and the flywheel 37, 237 is employed as the rotatable element mounted on the end of the rotatable shaft member. However, the rotatable shaft member and the rotatable element mounted thereon may be provided separately from the crankshaft and the flywheel. The engine cooling medium may be a liquid such as water rather than lubricating oil.

Figure 4:
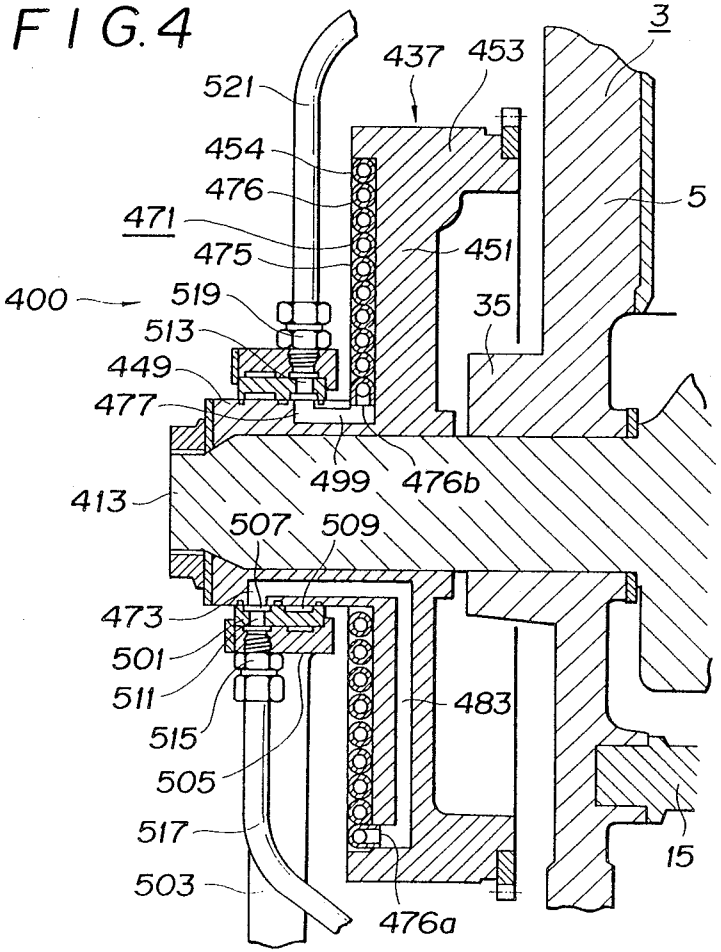
FIG. 4 is a vertical cross-sectional view of a cooling structure for cooling an engine with a cooling liquid according to a third embodiment of the present invention.

FIG. 4 shows a cooling structure 400 for cooling an engine with a cooling liquid according to a third embodiment of the present invention.

The engine cooling structure 400 is different from the engine cooling structures 10, 200 in that a radiation passage system and an engine cooling passage system are interconnected by a tube of copper which has a high thermal conductivity. Those parts shown in FIG. 4 which are identical to those of the previous embodiments are designated by identical reference numerals, and will not be described in detail.

A flywheel 437 comprises a disc 451, a boss 449 fitted over a crankshaft 413 and projecting from a central portion of the disc 451 transversely thereto, and a cylindrical flange 453 extending axially from the outer circumferential portion of the disc 451 toward the cylinder block 5. The disc 451 has a circular recess 454 of a prescribed diameter defined in the outer surface of the disc 451.

The radiation passage system 471 comprises a lubricant inlet 473, a spiral passage 475, and a lubricant outlet 477. The spiral passage 475 is defined in a single tube 476 of copper which is spirally coiled in a vertical plane and fitted in the recess 454. The tube 476 may be made of a material other than copper insofar as such a material has a high thermal conductivity.

The flywheel 437 has a passage 483 defined in the boss 449 and extending axially from the lubricant inlet 473 and then radially outwardly through the disc 451. The passage 483 has a radially outer end communicating with a radially outer end **476*a* of the tube 476. The lubricant inlet 473 is directed such that the passage 483 opens therethrough at the outer circumferential surface of the boss 449**.

The boss 449 has a passage 499 extending axially from the radially inner circumferential edge of the recess 454 and held in communication with the radially inner end 476*b* of the tube 476. The lubricant outlet 477 is directed such that the passage 499 opens therethrough at the outer circumferential surface of the boss 449.

The cooling passage system 101 (not shown in FIG. 4) in the engine case 3 ad the radiation passage 471 are interconnected as follows:

A holder 503 is attached to the engine case 3 and has a cylindrical support 505 with an annular member 501 fitted therein. The annular member 501 has a pair of annular grooves 507, 509 defined in its inner circumferential surface in radial alignment with the lubricant inlet 473 and the lubricant outlet 477, respectively. The annular grooves 507, 509 communicate respectively with copper tubes 517, 521, respectively, through corresponding passages 511, 513 defined radially through the annular member 501. The copper tubes 517, 521 are attached to the cylindrical support 505 through respective joints 515, 519. The copper tube 517 which communicates with the lubricant inlet 473 is connected to the oil pump 25 (not shown in FIG. 4). The copper tube 521 communicating with the lubricating outlet 477 is connected to the passages 111, 113 (not shown in FIG. 4) around the cylinder.

With the engine cooling structure 400, the heat of lubricating oil is radiated from the radiation passage system 471. The engine cooling structure 400 has basically the same construction as that of the engine cooling structure 10. Therefore, the engine cooling structure 400 is also effective in making the engine system compact.

The lubricant inlet 473 and outlet 47 of the radiation passage system 471 are coupled respectively to the oil pump and the engine cooling passage system through the respective copper tubes 517, 521. Therefore, the radiating passage system 471 can be designed with a greater degree of freedom.

Although there have been described what are at present considered to be the preferred embodiments of the present invention, it will be understood that the invention may be embodied in other specific forms without departing from the essential characteristics thereof. The present embodiments are therefore to be considered in all aspects as illustrative, and not restrictive. The scope of the invention is indicated by the appended claims rather than by the foregoing description.

We claim:

1. A cooling structure for cooling a liquid-cooled engine having cooling passages therein for circulation of a liquid cooling medium therethrough, said cooling structure comprising:

a rotatable assembly located outside of the engine and driven by the engine, said assembly comprising a shaft extending through at least a portion of the engine and an auxiliary rotatable element mounted on a portion of said shaft which projects out of the engine;

said auxiliary element comprising a disc element having at least first and second axially divided portions, a portion thereof comprising a sinuous passage for lowering the temperature of a liquid cooling medium; and means for connecting a liquid medium of said engine to said auxiliary element for circulation through said sinuous passage.

2. A cooling structure as recited in claim 1, wherein said disc element first and second portions comprise mating surfaces forming a labyrinth passage therebetween, one of said portions having a substantially planar surface and the other of said portions being formed with a plurality of concentric arcuate walls projecting against the mating surface of said one portion, adjacent arcuate walls having angularly displaced recesses therein for passage of fluid so as to define a labyrinth forming said sinuous passage.

3. A cooling structure as recited in claim 2, wherein said liquid cooling medium is an engine oil lubricant, and wherein said means for connecting the liquid cooling medium to said auxiliary element comprises an axially extending passageway formed in said shaft, extending through a portion of the engine at a journal thereof, and means for connecting said engine oil lubricant to be pumped through said axially extending passageway such that said shaft journal is lubricated thereby.

4. A cooling structure as recited in claim 3, further including an oil pump connected to a camshaft of said engine to be driven thereby to pump said engine oil lubricant, and wherein said means for connecting the liquid cooling medium to the auxiliary element further includes a passage formed axially in said camshaft and connected to the output of said oil pump.

5. A cooling structure as recited in claim 1, wherein said disc element first portion has a substantially planar surface and said disc element second portion comprises a tube spirally coiled and joined to said planar surface of said first portion, said spirally coiled tube defining said sinuous passage.

6. A cooling structure as recited in claim 5, wherein said liquid cooling medium is an engine oil lubricant, and wherein said means for connecting the liquid cooling medium to said auxiliary element comprises an axially extending passageway formed in said shaft, extending through a portion of the engine at a journal thereof, and means for connecting said engine oil lubricant to be pumped through said axially extending passageway such that said shaft journal is lubricated thereby.

7. A cooling structure as recited in claim 6, further including an oil pump connected to a camshaft of said engine to be driven thereby to pump said engine oil lubricant, and wherein said means for connecting the liquid cooling medium to the auxiliary element further includes a passage formed axially in said camshaft and connected to the output of said oil pump.

8. A cooling structure as recited in claim 1, wherein said liquid cooling medium is an engine oil lubricant, and wherein said means for connecting the liquid cooling medium to said auxiliary element comprises an axially extending passageway formed in said shaft, extending through a portion of the engine at a journal thereof, and means for connecting said engine oil lubricant to be pumped through said axially extending passageway such that said shaft journal is lubricated thereby.

9. A cooling structure as recited in claim 8, further including an oil pump connected to a camshaft of said engine to be driven thereby to pump said engine oil lubricant, and wherein said means for connecting the liquid cooling medium to the auxiliary element further includes a passage formed axially in said camshaft and connected to the output of said oil pump.

10. A cooling structure for cooling a liquid-cooled engine having cooling passages therein for circulation of a liquid cooling medium therethrough, said cooling structure comprising:

an engine flywheel connected to a crankshaft of the engine to be driven thereby, said flywheel including liquid cooling apparatus comprising a sinuous passage for lowering the temperature of a liquid medium circulated therethrough;

pump means driven by the engine for circulating engine oil lubricant as a liquid cooling medium;

passageway means formed in said crankshaft at a portion thereof passing through a crankshaft journal; and means for connecting said pump means to pump engine oil lubricant through said passageway means, said liquid cooling apparatus, and said engine cooling passages for cooling said engine, said crankshaft journal being simultaneously lubricated by said oil passing therethrough.

11. A cooling structure as recited in claim 10, wherein said liquid cooling apparatus comprises a labyrinth passage formed between a pair of mating axially separated surfaces of said flywheel, a first surface being substantially planar and a second surface being formed with a plurality of concentric arcuate walls projecting against said first surface, adjacent arcuate walls having angularly displaced recesses therein for passage of fluid, a labyrinth formed by said arcuate walls defining said sinuous passage.

12. A cooling structure as recited in claim 11, wherein said pump means is connected to a camshaft of the engine to be driven thereby, and said camshaft includes a passage formed axially therein through which output of said pump means is connected to pump engine oil to said passageway means.

13. A cooling structure as recited in claim 10, wherein said liquid cooling apparatus comprises a tube spirally coiled and joined to a surface of said flywheel, said tube defining said sinuous passage.

14. A cooling structure as recited in claim 13, wherein said pump means is connected to a camshaft of the engine to be driven thereby, and said camshaft includes a passage formed axially therein through which output of said pump means is connected to pump engine oil to said passageway means.

15. A cooling structure as recited in claim 10, wherein said pump means is connected to a camshaft of the engine to be driven thereby, and said camshaft includes a passage formed axially therein through which output of said pump means is connected to pump engine oil to said passageway means.

16. A cooling structure as recited in claim 10, wherein said sinuous passage for lowering the temperature of said liquid cooling medium comprises a spiral passage which has an inlet and an outlet at an outer periphery and a central portion of said flywheel, respectively, so that the spiral passage pervades the whole of said flywheel.

* * * * *